US005699994A

United States Patent [19]

Wu

[11] Patent Number: 5,699,994

[45] Date of Patent: Dec. 23, 1997

[54] SENSOR-TYPE FLUSH VALVE ASSEMBLY WITH PUSH BUTTON DEVICE FOR OPTIONAL MANUAL OPERATION

[75] Inventor: Mc-Gavour Wu, Nan-Tou, Taiwan

[73] Assignee: Hydrotek Corp., Nan-Tou, Taiwan

[21] Appl. No.: 713,159

[22] Filed: Sep. 12, 1996

[51] Int. Cl.[6] ..... F16K 31/06

[52] U.S. Cl. ..... 251/129.03

[58] Field of Search ..... 251/129.03, 129.04, 251/14

[56] References Cited

U.S. PATENT DOCUMENTS

| | | | |
|---|---|---|---|
| 2,861,592 | 11/1958 | Collins | 251/129.03 X |
| 3,938,555 | 2/1976 | Swickley | 251/129.03 X |
| 4,627,597 | 12/1986 | Brausfeld et al. | 251/129.03 |

*Primary Examiner*—Kevin Lee
*Attorney, Agent, or Firm*—Charles E. Wands

[57] ABSTRACT

A sensor-type flush valve assembly includes a hollow main valve body which confines an axial space with a top end portion and a lower end portion. The main valve body is formed with an inwardly and radially extending valve seat, a radial inlet port communicated with the axial space and disposed above the Valve seat, and a downwardly extending outlet port disposed below the valve seat and provided with a radial mounting hole which has an axis that is angularly spaced from that of the inlet port. The main valve body is further formed with an axially extending through-hole which extends from the mounting hole to the top end portion of the axial space. A movable valve piece is disposed in the axial space and normally blocks the valve seat. The valve piece has top and bottom sides and is formed with an axially extending water hole for guiding water from the bottom side to the top side of the valve piece. A push button device is mounted in the mounting hole and is operable from a normal state, wherein fluid flow from the first through-hole to the outlet port is blocked, and an operated state, wherein fluid flow from the first through-hole to the outlet port is permitted. In the operated state, reduced pressure at the top side of the valve piece will cause the valve piece to move away from the valve seat.

6 Claims, 7 Drawing Sheets

SENSOR-TYPE FLUSH VALVE ASSEMBLY WITH PUSH BUTTON DEVICE FOR OPTIONAL MANUAL OPERATION

BACKGROUND OF THE INVENTION

1. Field of the Invention

The invention relates to a sensor-type flush valve assembly, more particularly to a sensor-type flush valve assembly with a push button device for optional manual operation.

2. Description of the Related Art

Sensor-type flush valve assemblies for urinals and the like are known in the art. Although such valve assemblies are popular in view of their ease of operation, they are sometimes inconvenient to use, especially when a sensor unit of the valve assembly is damaged or when a power source of the valve assembly is used up.

Another drawback of conventional flush valve assemblies resides in that they can only be secured to a water inlet pipe that is disposed on one side thereof. That is to say, a flush valve assembly designed for connection with a water inlet pipe on a right side thereof cannot be installed when the water inlet pipe is disposed on its left side.

SUMMARY OF THE INVENTION

Therefore, the main object of this invention is to provide a sensor-type flush valve assembly with a push button device for optional manual operation.

Another object of this invention is to provide a sensor-type flush valve assembly which can be installed regardless of whether the water inlet pipe is disposed on its left or right side.

Accordingly, the sensor-type flush valve assembly of this invention comprises:

a hollow main valve body having a top section and confining an axial space with a top end portion and a lower end portion, the main valve body being formed with an inwardly and radially extending valve seat in the lower end portion of the axial space, a radial inlet port communicated with the axial space and disposed above the valve seat, and a downwardly extending outlet port disposed below the valve seat and provided with a radial first mounting hole which has an axis that is angularly spaced from that of the inlet port, the main valve body being further formed with an axially extending first through-hole which extends from the first mounting hole to the top end portion of the axial space;

a movable valve piece disposed in the axial space and normally blocking the valve seat, the valve piece having top and bottom sides and being formed with an axially extending water hole for guiding water from the bottom side to the top side of the valve piece;

an electromagnet unit mounted on the top section of the main valve body and associated operably with the valve piece so as to move the valve piece away from the valve seat in order to permit water flow from the inlet port to the outlet port when the electromagnet unit is activated;

a casing secured on the top section of the main valve body to house the electromagnet unit therein;

a power supplying unit disposed in the casing and connected electrically to the electromagnet unit;

a sensor unit mounted on the casing and operable so as to activate the power supplying unit to activate in turn the electromagnet unit; and a push button device mounted in the first mounting hole and operable from a normal state, wherein fluid flow from the first through-hole to the outlet port is blocked, and an operated state, wherein fluid flow from the first through-hole to the outlet port is permitted.

The first mounting hole has an inner section, an intermediate section wider than the inner section, and an outer section wider than the intermediate section. The first through-hole extends from the intermediate section of the first mounting hole to the top end portion of the axial space. The push button device includes: a push member movably retained on the outlet port of the main valve body and formed with a shank portion that extends slidably and sealingly into the inner section of the first mounting hole, and a head portion that is formed on one end of the shank portion, the shank portion being formed with a water passage which includes a radial portion that is located at an intermediate part of the shank portion and an axial portion that extends axially from a tip of the shank portion and that communicates fluidly the radial portion with the outlet port, the radial portion being aligned with the first through-hole when the push member is in the operated state; a blocking ring sleeved on the shank portion of the push member and positioned in the outer section of the first mounting hole, the blocking ring blocking entrance to the radial portion of the water passage to prevent fluid flow from the first through-hole to the outlet port when the push member is in the normal state; a biasing spring sleeved on the shank portion and disposed between the blocking ring and the head portion, the biasing spring biasing the push member to the normal state; and a tubular cap disposed around the head portion of the push member and formed with an opening to permit extension of the head portion therethrough, the cap having an end portion which extends into the outer section of the first mounting hole and which is mounted removably thereto so as to retain removably the push member, the blocking ring and the biasing spring in the first mounting hole.

The outlet port is formed with a radial second mounting hole diametrically opposite and identical to the first mounting hole. The main valve body is further formed with an axially extending second through-hole which extends from the second mounting hole to the top end portion of the axial space. A plug is mounted removably in the second mounting hole to block water flow from the second through-hole to the outlet port.

Preferably, the axes of the first and second mounting holes are generally transverse to that of the inlet port.

BRIEF DESCRIPTION OF THE DRAWINGS

Other features and advantages of this invention will become apparent in the following detailed description of the preferred embodiment with reference to the accompanying drawings, of which.

DETAILED DESCRIPTION OF THE PREFERRED EMBODIMENT

Figure 1:
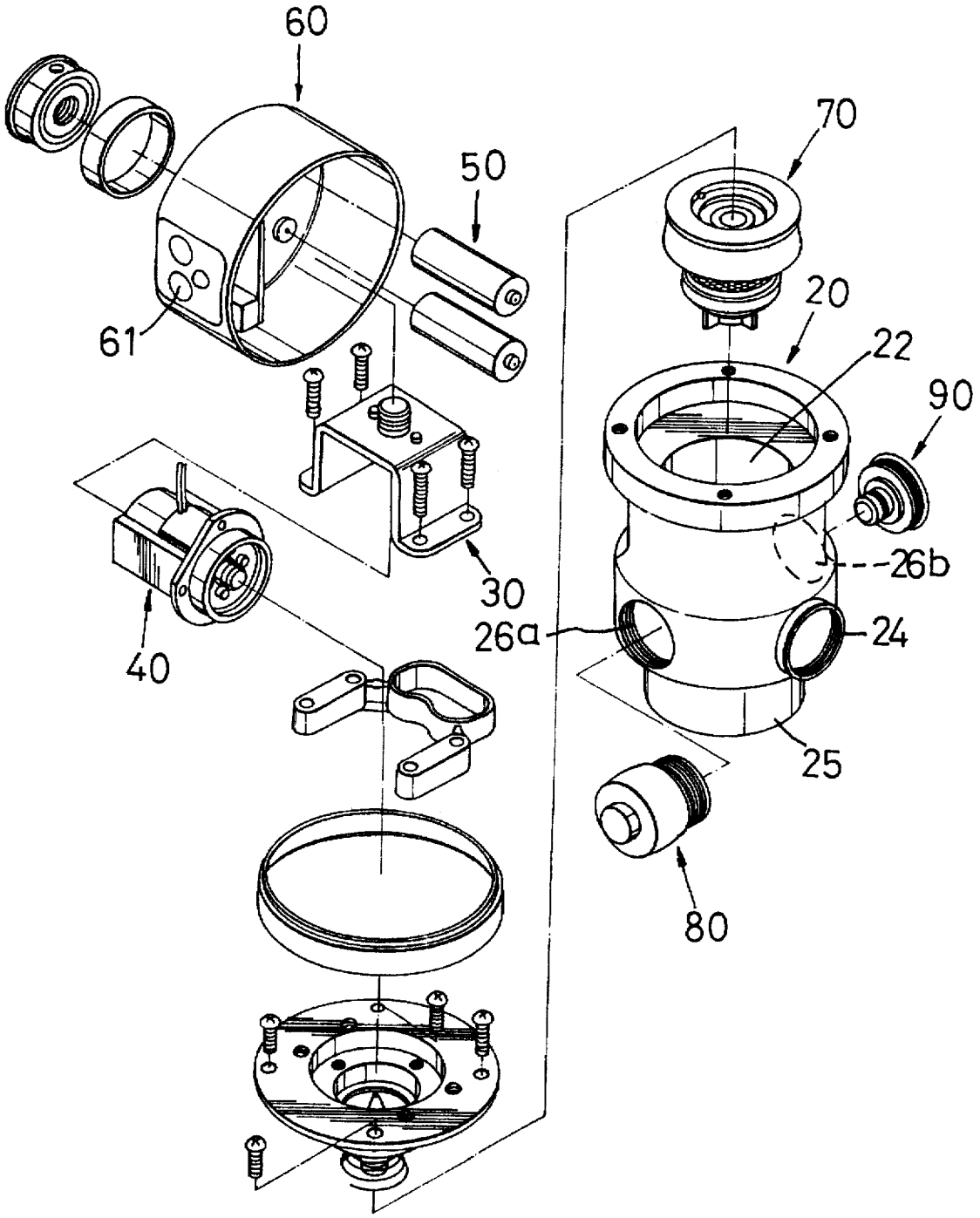
FIG. 1 is an exploded view of the preferred embodiment of a sensor-type flush valve assembly according to this invention.
Figure 2:
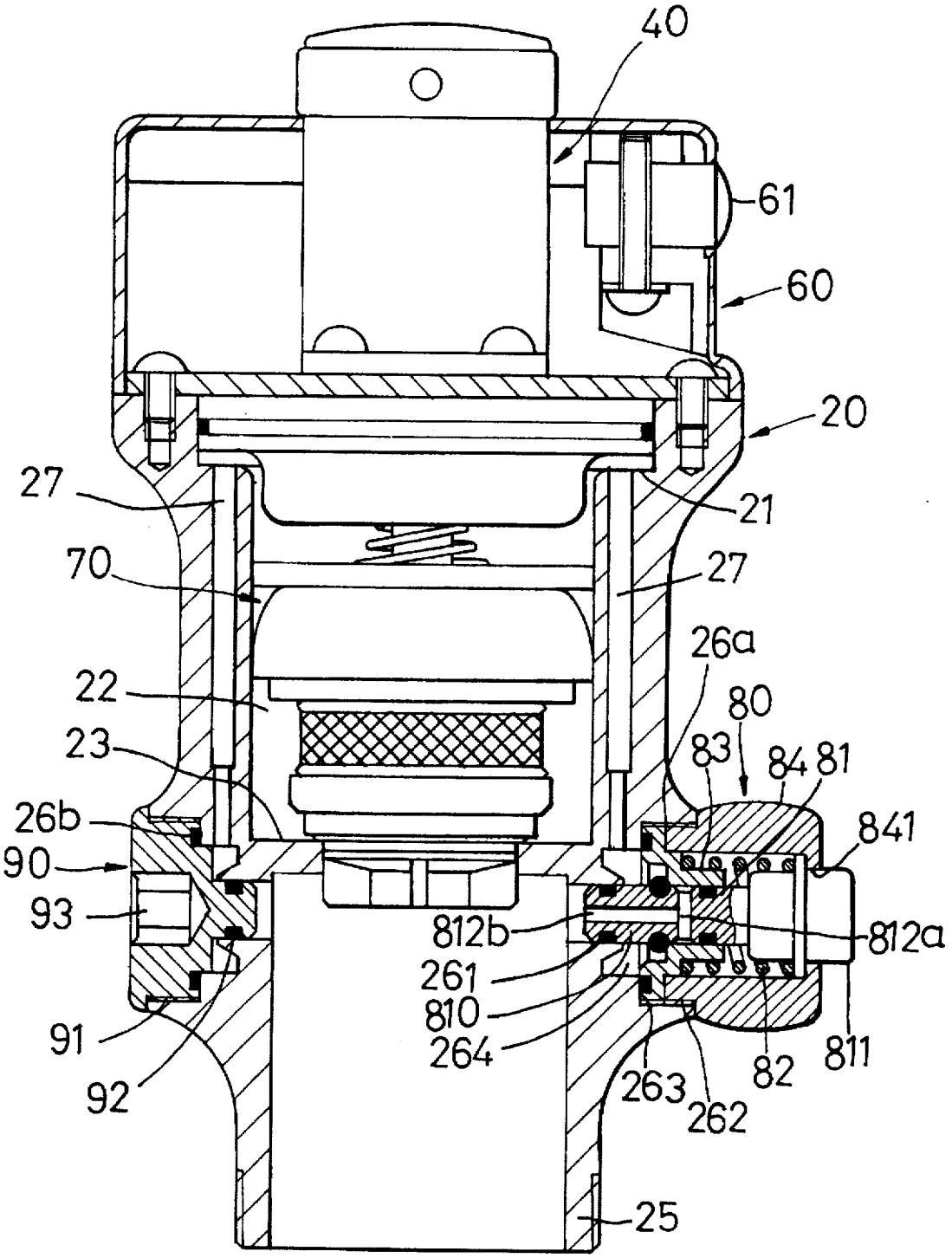
FIG. 2 is a sectional view of the preferred embodiment.
Figure 3:
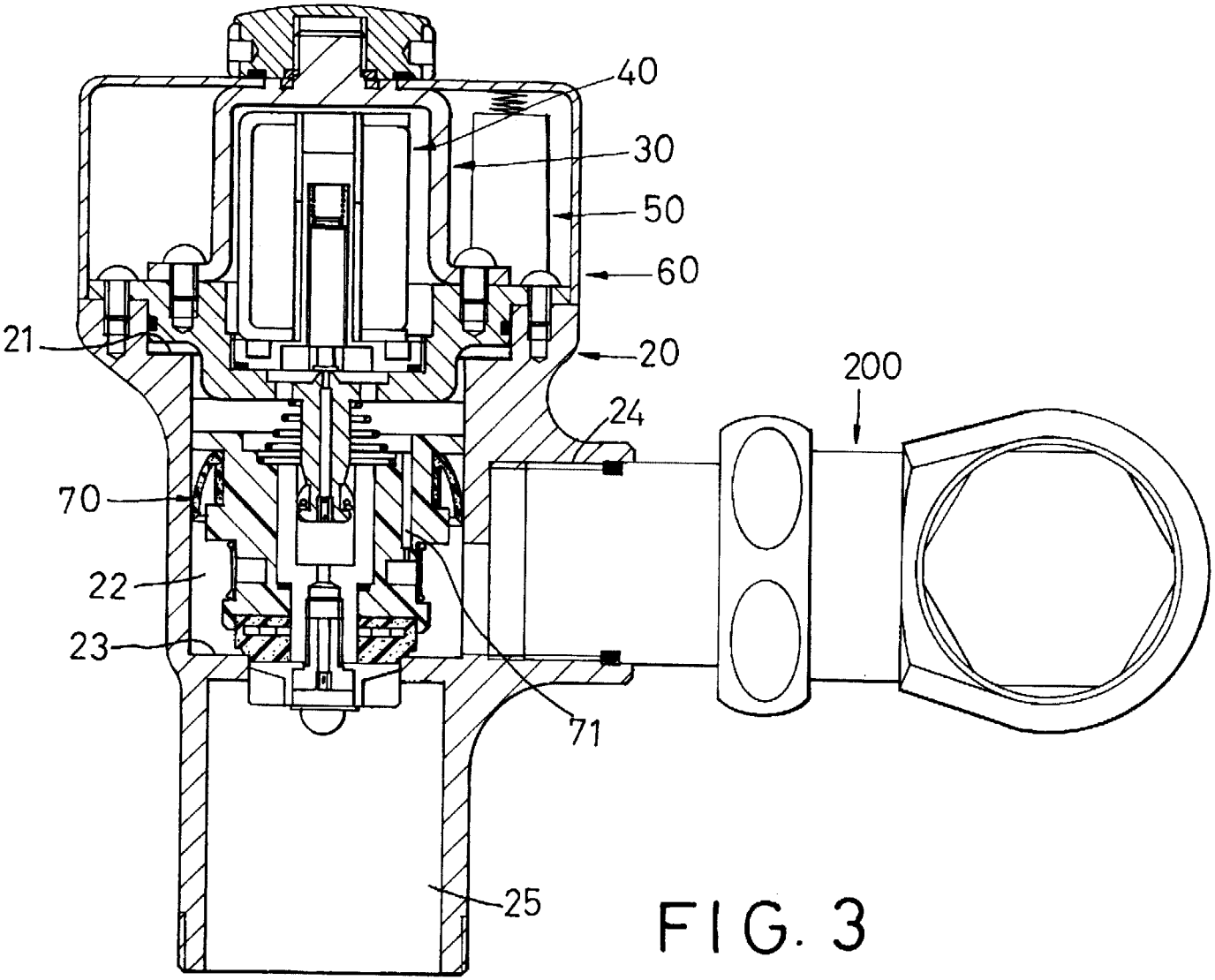
FIG. 3 is another sectional view of the preferred embodiment.
Figure 4:
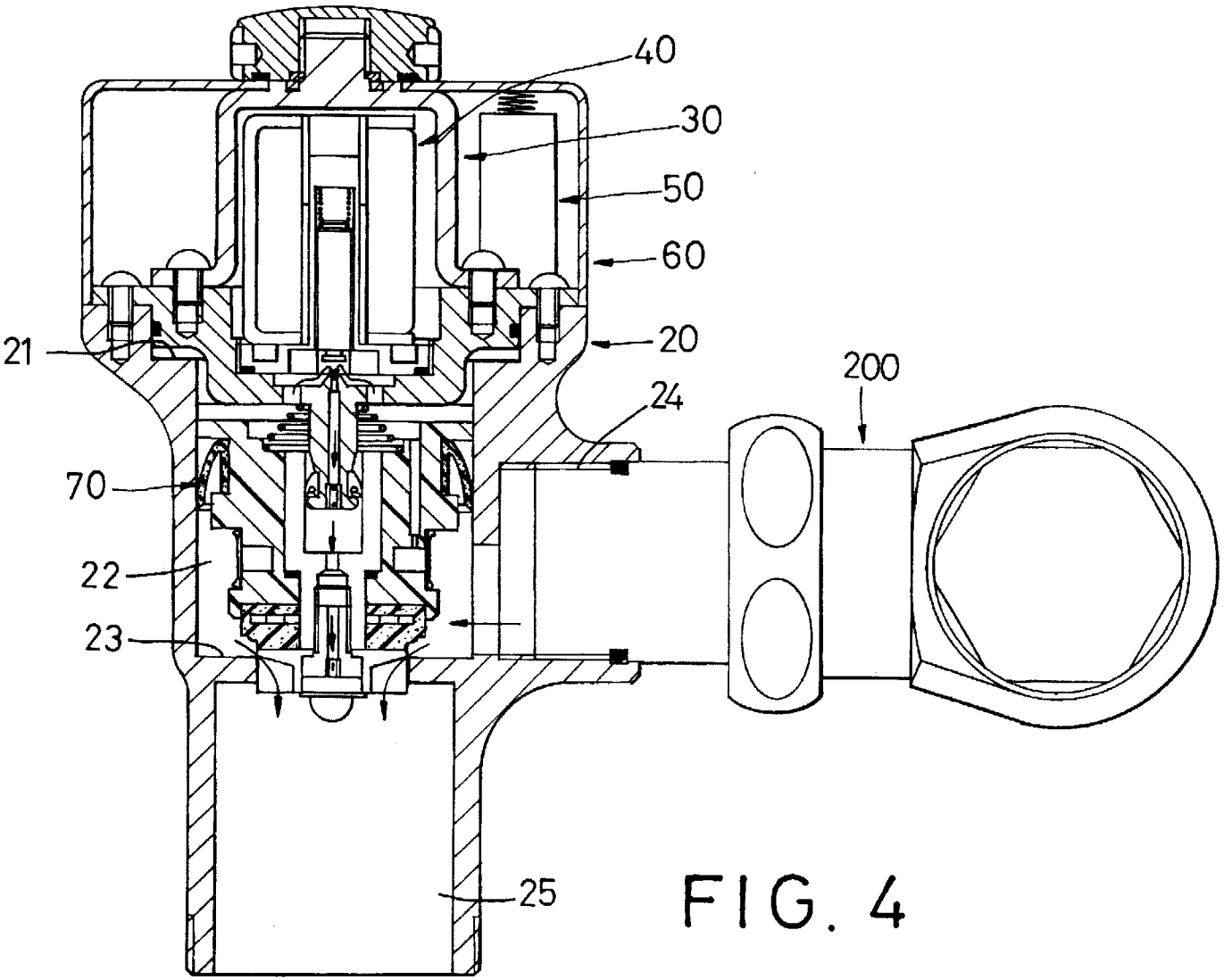
FIG. 4 illustrates the operation of the preferred embodiment in an automatic mode.

Referring to FIGS. 1 to 3, the preferred embodiment of a sensor-type flush valve assembly according to this invention is shown to comprise a hollow main valve body 20 which confines an axial space 22 that has a wider top end portion, thereby forming an annular shoulder 21 in a top section of the main valve body 20. The main valve body 20 is formed with an inwardly and radially extending valve seat 23 in a lower end portion of the axial space 22, a radial inlet port 24 communicated with the axial space 22 and disposed above the valve seat 23, and a downwardly extending axial outlet port 25 disposed below the valve seat 23. The inlet and outlet ports 24, 25 are connectable respectively to a water inlet pipe 200 and a water outlet pipe (not shown). A movable valve piece 70 is disposed in the axial space 22 and normally blocks the valve seat 23. An electromagnet unit 40 is mounted on the top section of the main valve body 20 by means of a mounting unit 30. The electromagnet unit 40 is associated operably with the valve piece 70 in a known manner so as to open or close the valve seat 23. A casing 60 is secured on the top section of the main valve body 20 to house the electromagnet unit 40 therein. A power supplying unit 50, which includes batteries, is disposed in the casing 60 and is connected to the electromagnet unit 40. An optical sensor unit 61 is mounted on the casing 60 and activates or deactivates the power supplying unit 50 in a known manner. Upon activation of the power supplying unit 50 by the sensor unit 61, the valve piece 70 is moved by the electromagnet unit 40 away from the valve seat 23 in a known manner, thereby permitting water flow from the inlet port 24 to the outlet port 25, as shown in FIG. 4. The valve piece 70 is further formed with an axially extending water hole 71 for guiding water from a bottom side to a top side of the valve piece 70.

The outlet port 25 is formed with a pair of diametrically opposite and identical radial mounting holes **26*a*, 26*b*, the axes of which are preferably generally transverse to that of the inlet port 24. Each of the mounting holes 26*a*, 26*b* has an inner section 261, an intermediate section 264 wider than the inner section 261, and an outer section 262 wider than the intermediate section 264 and threaded internally. An annular bearing shoulder 263 is formed at the junction of the intermediate and outer sections 264, 262. The main valve body 20 is further formed with a pair of axially extending through-holes 27, each of which extends from the intermediate section 264 of a respective one of the mounting holes 26*a*, 26*b* to the annular shoulder 21 in the top end portion of the axial space 22**.

The valve assembly of this invention further comprises a push button device 80 which includes a push member 81, a biasing spring 82, a blocking ring 83 and a tubular cap 84. The spring 82 and the blocking ring 83 are sleeved on the push member 81. The push member 81 is formed with a shank portion 810 which extends slidably and sealingly into the inner section 261 of the mounting hole **26*a*, and a head portion 811 on one end of the shank portion 810. The shank portion 810 is formed with a T-shaped water passage which includes a radial portion 812*a* and an axial portion 812*b*. The radial portion 812*a* is located at an intermediate part of the shank portion 810. The axial portion 812*b* extends axially from a tip of the shank portion 810 and communicates fluidly the radial portion 812*a* with the outlet port 25. The radial portion 812*a* is aligned with the through-hole 27 when the push member 81 is operated. The blocking ring 83 is positioned in the outer section 262 of the mounting hole 26*a* and abuts against the bearing shoulder 263. The blocking ring 83 blocks entrance to the radial portion 812*a* of the water passage to prevent fluid flow from the through-hole 27 to the outlet port 25 when the push member 81 is in a normal state. The spring 82 is disposed between the blocking ring 83 and the head portion 811 of the push member 81 and provides a restoring force for biasing the push member 81 to the normal state, e.g. moving the push member 81 outwardly of the mounting hole 26*a*, after a pressing force on the push member 81 is removed. The cap 84 is disposed around the head portion 811 of the push member 81 and is formed with an opening to permit extension of the head portion 811 therethrough. The cap 84 has an externally threaded end portion which extends into the outer section 262 of the mounting hole 26*a* and which engages the internal thread thereat. The push member 81, the biasing spring 82 and the blocking ring 83 are removably retained in the mounting hole 26*a*** at this time.

The valve assembly further includes a plug 90 which is formed with an external screw thread 91 for engaging the internal thread of the outer section 262 of the mounting hole **26*b*, and a restricted stub projection 92 which extends sealingly into the inner section 261 of the mounting hole 26*b* to block water flow from the other one of the through-holes 27 to the outlet port 25. The plug 90 is formed with a hexagonal blind hole 93 for driving rotatably the plug 90** with the use of a tool (not shown).

Figure 5:
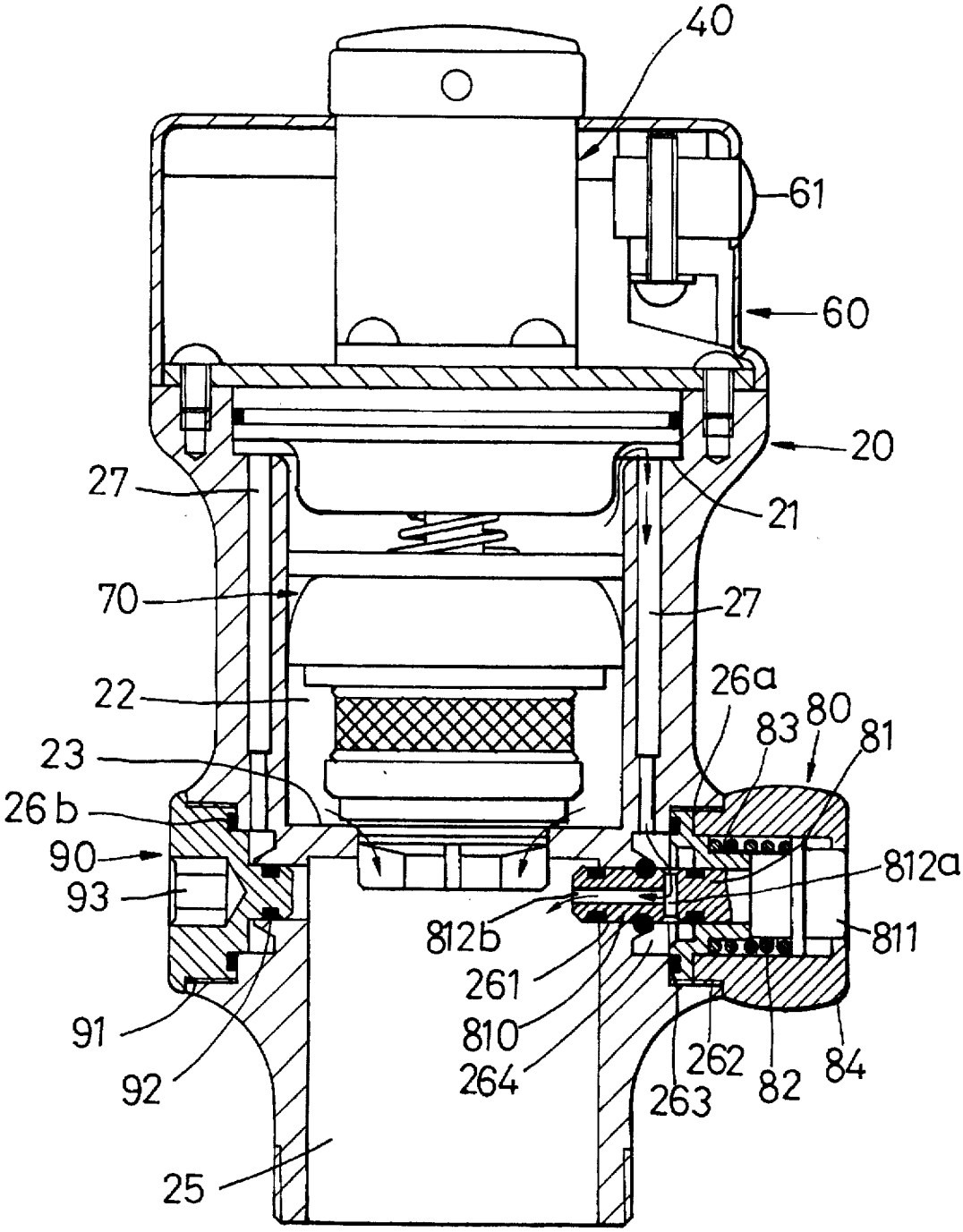
FIG. 5 illustrates the operation of the preferred embodiment in a manual mode.

Referring to FIG. 5, when it is desired to operate the flush valve assembly manually, the head portion 811 of the push member 81 is depressed such that the shank portion 810 extends further into the inner section 261 of the mounting hole **26*a*. At this time, the blocking ring 83 ceases to block the radial portion 812*a* of the water passage formed through the shank portion 810, and the water passage is now in fluid communication with the respective one of the through-holes 27 in the main valve body 20 via the intermediate section 264 of the mounting hole 26*a*. Thus, water in the top side of the valve piece 70 can flow into the outlet port 25 via the through-hole 27, the intermediate section 264 of the mounting hole 26*a* and the water passage in the shank portion 810 of the push member 81, thereby resulting in a drop in pressure at the top side of the valve piece 70. In view of the pressure difference at the top and bottom sides of the valve piece 70, the valve piece 70 moves upwardly away from the valve seat 23, thereby resulting in water flow from the inlet port 24 to the outlet port 25** for flushing purposes.

When the pressure that was applied on the head portion 811 of the push member 81 is released, the biasing spring 82 expands to restore the push member 81 to the normal state. At this time, the radial portion **812*a* of the water passage in the shank portion 810 of the push member 81 is once again blocked by the blocking ring 83, thereby preventing water at the top side of the valve piece 70 from flowing into the outlet port 25 via the through-hole 27. Water then accumulates in the top side of the valve piece 70 until the valve piece 70 once again blocks the valve seat 23** to terminate the flushing operation.

Figure 6:
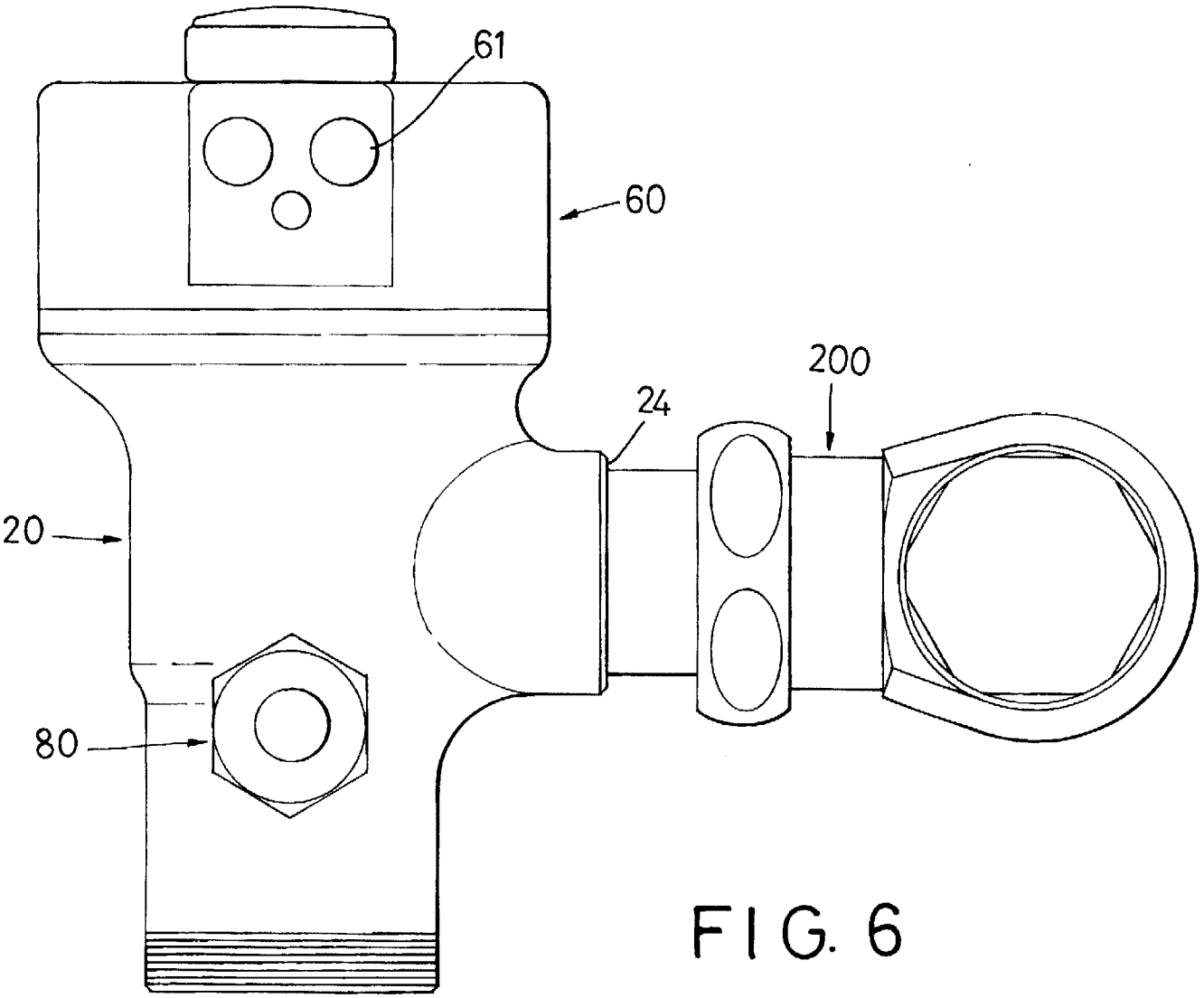
FIG. 6 illustrates the preferred embodiment when connected to a water inlet pipe that is disposed on a right side thereof.
Figure 7:
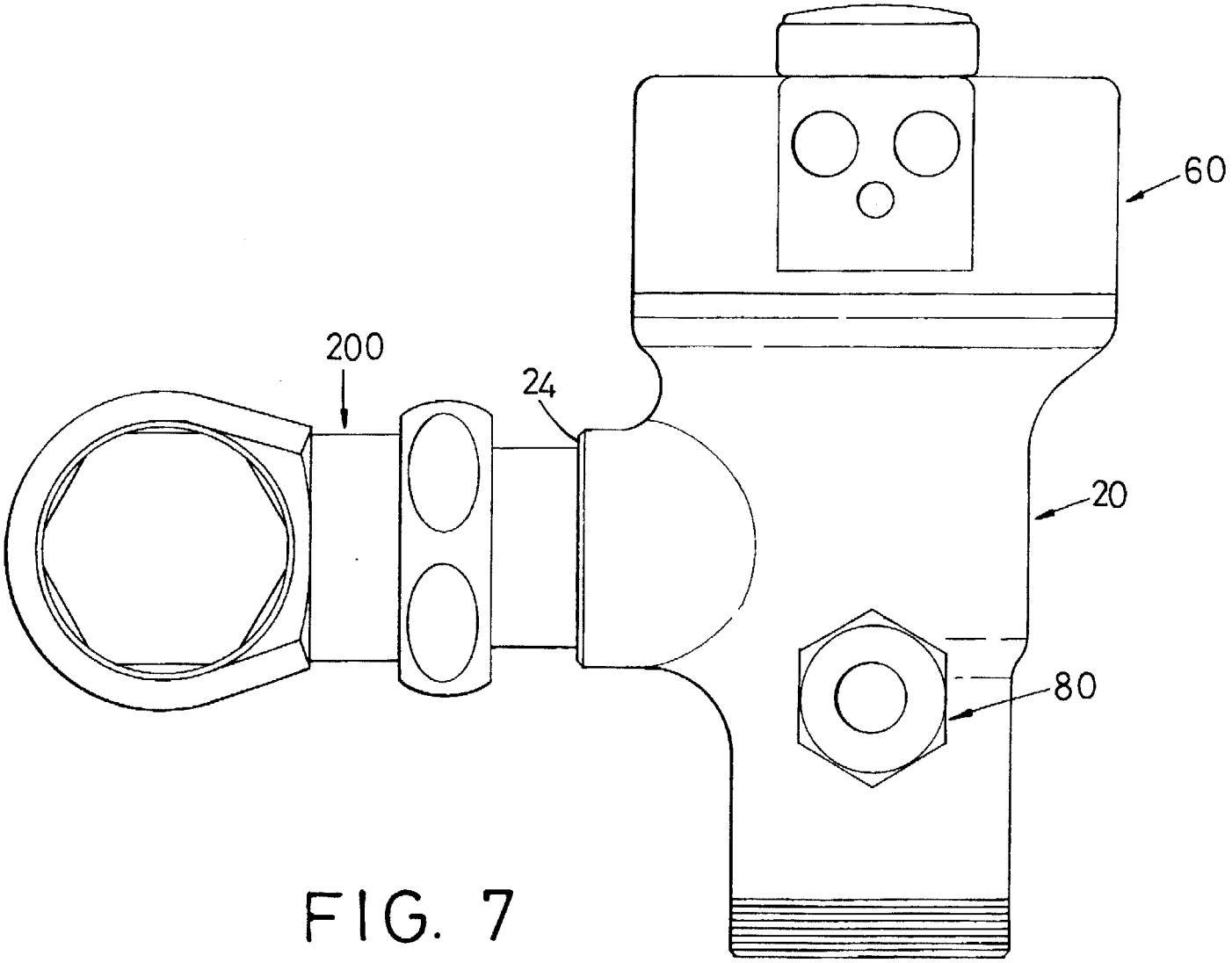
FIG. 7 illustrates the preferred embodiment when connected to a water inlet pipe that is disposed on a left side thereof.

FIG. 6 illustrates the flush valve assembly when secured to a water inlet pipe 200 that is disposed on a right side thereof. As shown, the push button device 80 is installed on the front side of the main valve body 20 to facilitate operation thereof, while the plug 90 is installed on the rear side of the main valve body 20. FIG. 7 illustrates the flush valve assembly when secured to a water inlet pipe 200 that is disposed on a left side thereof. As shown, the push button device 80 and the plug 90 can still be respectively installed on the front and rear sides of the main valve body 20 due to the presence of the identical mounting holes 26a, 26b which are communicated with the top end portion of the axial space 22 via the respective one of the through-holes 27.

It has thus been shown that the flush valve assembly of this invention, which incorporates a push button device, can be operated even when the sensor unit of the valve assembly is damaged or when the power source of the valve assembly is used up. In addition, the flush valve assembly can be secured to a water inlet pipe regardless of whether the inlet pipe is disposed on its left or right side. The objects of the present invention are thus met.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A sensor-type flush valve assembly comprising:

a hollow main valve body having a top section and confining an axial space with a top end portion and a lower end portion, said main valve body being formed with an inwardly and radially extending valve seat in said lower end portion of said axial space, a radial inlet port communicated with said axial space and disposed above said valve seat, and a downwardly extending outlet port disposed below said valve seat and provided with a radial first mounting hole which has an axis that is angularly spaced from that of said inlet port, said main valve body being further formed with an axially extending first through-hole which extends from said first mounting hole to said top end portion of said axial space;

a movable valve piece disposed in said axial space and normally blocking said valve seat, said valve piece having top and bottom sides and being formed with an axially extending water hole for guiding water from said bottom side to said top side of said valve piece;

an electromagnet unit mounted on said top section of said main valve body and associated operably with said valve piece so as to move said valve piece away from said valve seat in order to permit water flow from said inlet port to said outlet port when said electromagnet unit is activated;

a casing secured on said top section of said main valve body to house said electromagnet unit therein;

a power supplying unit disposed in said casing and connected electrically to said electromagnet unit;

a sensor unit mounted on said casing and operable so as to activate said power supplying unit to activate in turn said electromagnet unit; and a push button device mounted in said first mounting hole and operable from a normal state, wherein fluid flow from said first through-hole to said outlet port is blocked, and an operated state, wherein fluid flow from said first through-hole to said outlet port is permitted.

2. The sensor-type flush valve assembly as claimed in claim 1, wherein:

said first mounting hole has an inner section, an intermediate section wider than said inner section, and an outer section wider than said intermediate section, said first through-hole extending from said intermediate section of said first mounting hole to said top end portion of said axial space; and said push button device includes: a push member movably retained on said outlet port of said main valve body and formed with a shank portion that extends slidably and sealingly into said inner section of said first mounting hole, and a head portion that is formed on one end of said shank portion, said shank portion being formed with a water passage which includes a radial portion that is located at an intermediate part of said shank portion and an axial portion that extends axially from a tip of said shank portion and that communicates fluidly said radial portion with said outlet port, said radial portion being aligned with said first through-hole when said push member is in the operated state; a blocking ring sleeved on said shank portion of said push member and positioned in said outer section of said first mounting hole, said blocking ring blocking entrance to said radial portion of said water passage to prevent fluid flow from said first through-hole to said outlet port when said push member is in the normal state; and a biasing spring sleeved on said shank portion and disposed between said blocking ring and said head portion, said biasing spring biasing said push member to the normal state.

3. The sensor-type flush valve assembly as claimed in claim 2, wherein said push button device further includes a tubular cap disposed around said head portion of said push member and formed with an opening to permit extension of said head portion therethrough, said cap having an end portion which extends into said outer section of said first mounting hole and which is mounted removably thereto so as to retain removably said push member, said blocking ring and said biasing spring in said first mounting hole.

4. The sensor-type flush valve assembly as claimed in claim 3, wherein said outlet port is formed with a radial second mounting hole diametrically opposite and identical to said first mounting hole, said main valve body being further formed with an axially extending second through-hole which extends from said second mounting hole to said top end portion of said axial space, said flush valve assembly further comprising a plug which is mounted removably in said second mounting hole to block water flow from said second through-hole to said outlet port.

5. The sensor-type flush valve assembly as claimed in claim 4, wherein the axes of said first and second mounting holes are generally transverse to that of said inlet port.

6. The sensor-type flush valve assembly as claimed in claim 1, wherein the axis of said first mounting hole is generally transverse to that of said inlet port.

* * * * *